United States Patent [19]

Riley

[11] 4,149,667

[45] Apr. 17, 1979

[54] DUAL COMPARTMENT ENVELOPE

[75] Inventor: Alden R. Riley, Saint Paul, Minn.

[73] Assignee: The Smead Manufacturing Company, Hastings, Minn.

[21] Appl. No.: 900,153

[22] Filed: Apr. 26, 1978

[51] Int. Cl.[2] ..... B65D 27/08

[52] U.S. Cl. ..... 229/72; 229/DIG. 3

[58] Field of Search ..... 229/72, 56, 68 R, DIG. 3

[56] References Cited

U.S. PATENT DOCUMENTS

| | | | |
|---|---|---|---|
| 2,344,369 | 3/1944 | Salfisberg | 229/56 |
| 3,198,420 | 8/1965 | Hiersteiner | 229/68 |
| 3,482,764 | 12/1969 | Aliff, Jr. et al. | 229/72 |
| 3,979,051 | 9/1976 | Close | 229/72 |

FOREIGN PATENT DOCUMENTS

| | | | |
|---|---|---|---|
| 677368 | 1/1964 | Canada | 229/72 |

*Primary Examiner*—Stephen P. Garbe

*Attorney, Agent, or Firm*—Merchant, Gould, Smith, Edell, Welter & Schmidt

[57] ABSTRACT

An improved dual compartment envelope having two vertically extending pockets. The envelope comprises a first sheet which is bent along a fold line to define a front and back panel. An intermediate sheet is placed between the front and back panels and is fixedly secured thereto. Two laterally extending flaps overlie and are integrally secured to the front panel and the second sheet to form the completed envelope. The front panel is substantially shorter than the back panel such that the entrance openings to the two pockets of the envelope are vertically offset to minimize the possibility of confusing the pockets when filing materials therein. Various score lines may be provided along the bend lines of the envelope to allow the envelope to be expanded.

3 Claims, 8 Drawing Figures

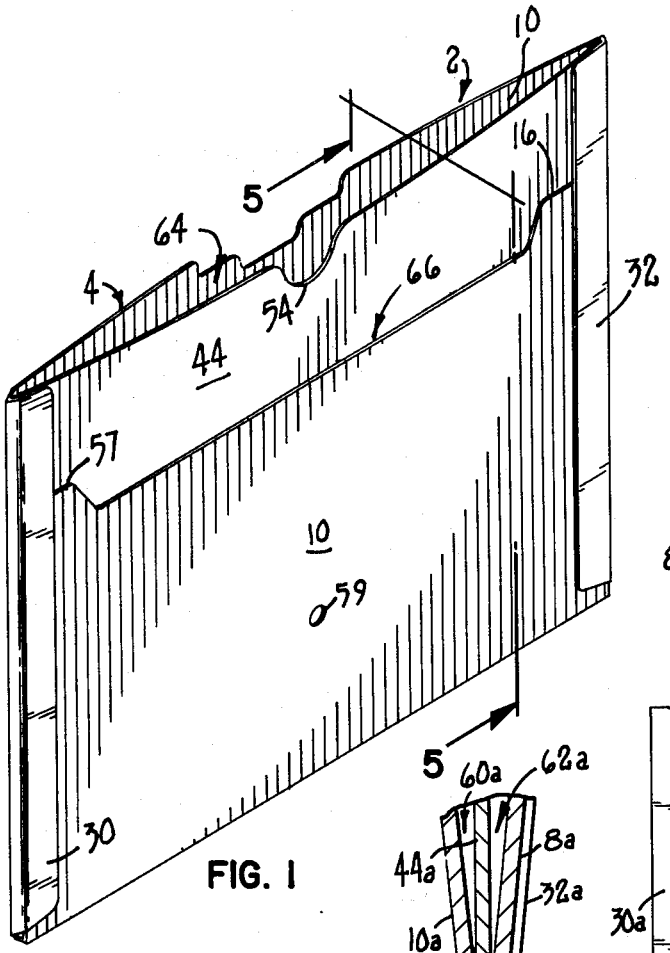
FIG. 1
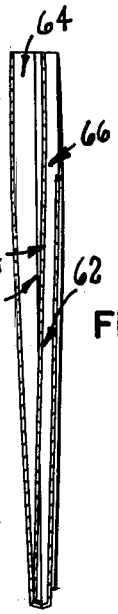
FIG. 5
FIG. 6
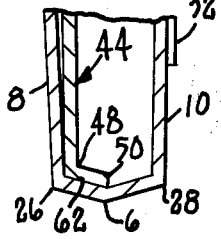
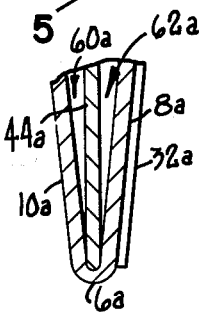
FIG. 8
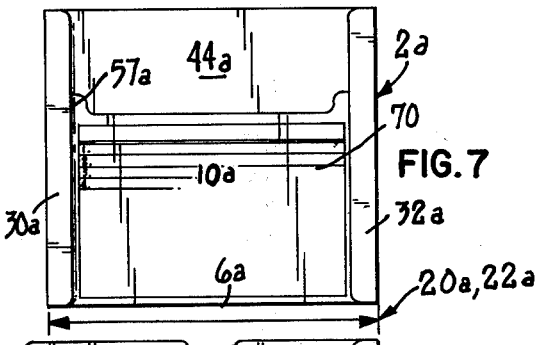
FIG. 7
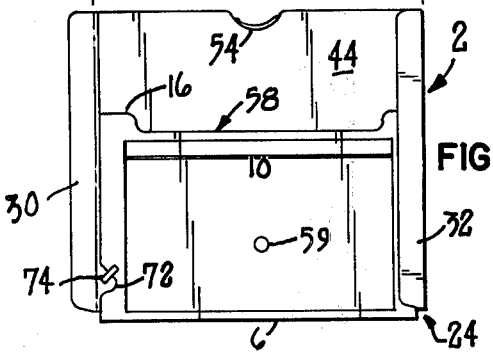
FIG. 4
FIG. 2
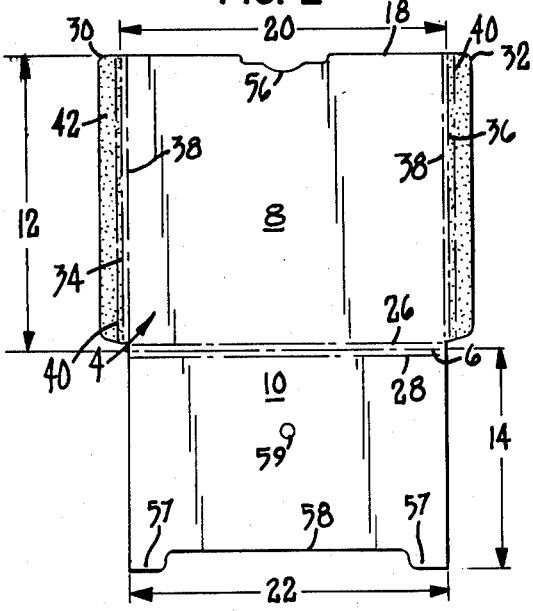
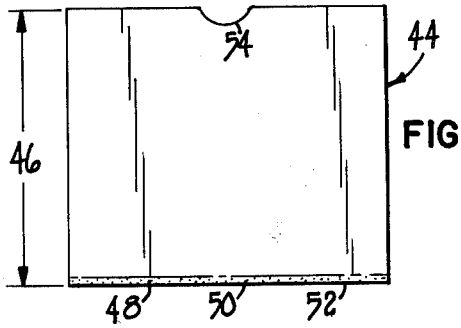
FIG. 3

DUAL COMPARTMENT ENVELOPE

BACKGROUND OF THE INVENTION

1. Field of the Invention

This invention relates to an envelope for holding various materials in a convenient and accessible manner. More particularly, this invention relates to an envelope of the dual compartment type for holding materials of a first kind in one compartment or pocket and materials of a second kind in the other compartment or pocket.

2. Description of the Prior Art

Physicians often use X-ray photographs to assist them in diagnosing and treating their patients. Such photographs are desirably retained in a convenient manner for record keeping purposes and for subsequent referral by the physician. In addition, various papers, charts, prescriptions, and other written memoranda accumulate regarding each of a physician's patients. The written materials relating to each patient should be stored in the same place as the X-ray photographs for that patient. Various types of dual compartment envelopes (i.e., envelopes having two pockets) have been proposed in the past for performing this function. Such envelopes store the X-ray photographs in one of the pockets thereof while the written materials are stored in the remaining pocket of the envelope.

One type of prior dual compartment envelope for use in storing the above-noted materials is that known as X-ray Envelope No. PCC6, manufactured by the Smead Manufacturing Company of Hastings, Minnesota, which company is also the assignee of the present invention. The PCC6 envelope generally contains two vertically extending pockets defined between a folded first sheet of stock material and an intermediate sheet of stock material placed between the panels of the folded first sheet. This envelope also contains various score lines adjacent the bottom fold and adjacent the sides of the envelope to allow the X-ray envelope to be expanded. Both of the pockets defined by the envelope are of substantially the same height. Thus, the entrance openings into the pockets are positioned proximately to one another.

Although the PCC6 envelope is quite effective for the purpose for which it was designed, the fact that both of the entrance openings to the pockets are positioned adjacent one another is disadvantageous. For example, if the person filing the X-ray photographs or other memoranda therein is not cautious, the possibility exists that these materials will be misfiled into the wrong pocket. In addition, the intermediate sheet does not extend to the bottom of the pockets but terminates some distance above the bottom. Thus, for extremely small memoranda, such memoranda could sometimes transfer from one pocket to the other by slipping underneath the intermediate sheet if the envelope were to be shaken or jarred. Such transfer between pockets will occur, however, only if the intermediate sheet which is normally adhesively secured to the back panel of the envelope should become detached from that panel.

U.S. Pat. No. 3,979,051 to Close depicts an alternative type of multi-compartment envelope. In the envelope defined by this patent, the inlet opening to one of the pockets is vertically offset from the inlet opening of the other pocket. THis was accomplished by forming the inlet opening to the first pocket from a transverse slot in the front panel. This slot communicates with the pocket defined between the front panel and the intermediate sheet. Although the inlet or entrance openings to the pockets were not directly contiguous to another in this type of envelope, such an arrangement had certain disadvantages. Among these was a tendency for the lateral sides of the slot to tear as papers or other memoranda were inserted into the first pocket. In addition, because the top of the slot was not open, it could be difficult to insert papers of approximately the same size of the slot into the pocket. Furthermore, the envelope defined by this patent was not designed to be expandable.

SUMMARY OF THE INVENTION

One aspect of this invention is the provision of a dual compartment envelope which defines an improved and efficient structure for conveniently and easily storing materials of various types.

The envelope according to this invention comprises a first unitary sheet of stock material folded in such a way so as to define front and back panels of unequal length. Laterally extending flaps protrude from either side of the back panel. An intermediate sheet is positioned between the front and back panels and has its bottom edge secured to the folded first sheet adjacent the bend line thereof. The intermediate sheet extends upwardly a distance which is substantially equal to the length of the back panel. These components of the envelope are assembled into an integral envelope by having the lateral flaps bent to overlie the front panel. The flaps ae then adhesively secured along the entire length of the front panel and that portion of the intermediate sheet which extends above the upper flap of the front panel. A first pocket is defined between the back panel and the intermediate sheet which pocket extends substantially over the entire length of the envelope. A second pocket is defined between the front panel and the intermediate sheet with the second pocket being substantially shorter than the first pocket and having an open upper inlet opening which is spaced substantially below the inlet opening of the first pocket. Such an orientation assists in the proper filing of materials into the pockets. The intermediate sheet preferably extends to the bottom of the envelope and has a score line which cooperates with score lines on the folded first sheet to allow the envelope to be expanded.

BRIEF DESCRIPTION OF THE DRAWINGS

The present invention will be described hereafter in the following Detailed Description, when taken in conjunction with the following drawings, in which like reference numerals will refer to like elements throughout the several views.

FIG. 1 is a perspective view of a first embodiment of an improved dual compartment envelope according to this invention, showing the envelope in a substantially open expanded form;

FIG. 2 is a top plan view of the first sheet of stock material which forms a portion of the envelope shown in FIG. 1, the first sheet being shown in FIG. 2 as a blank in an open orientation prior to assembly;

FIG. 3 is a bottom plan view of the second or intermediate sheet which forms a portion of the envelope of FIG. 1;

FIG. 4 is a top plan view of the envelope of FIG. 1, showing the envelope in a partially assembled form having one lateral flap not secured;

FIG. 5 is a cross-sectional view of the improved envelope shown in FIG. 1, taken along lines 5—5 of FIG. 1;

FIG. 6 is an enlarged cross-sectional view, similar to FIG. 5, of only the bottom portion of the envelope shown in FIG. 1;

FIG. 7 is a top plan view of a second embodiment of an improved envelope according to this invention; and FIG. 8 is an enlarged cross-sectional view of the bottom portion of the second embodiment of the envelope shown in FIG. 7.

DETAILED DESCRIPTION

Referring first to FIG. 1, an improved dual compartment envelope suitable for retaining X-ray photographs and various written materials is generally illustrated as 2. Envelope 2 includes two vertically extending compartment or pockets 60 and 62. Each of the pockets 60 and 62 has an open upper end 64 and 66, respectively, which defines an entrance opening to the pocket. The structure and function of envelope 2 will be described more particularly hereafter. Suffice it to say for now that X-ray photographs will generally be stored or filed in pockets 60, while various written material, including patient charts, prescriptions, memoranda and the like, will be stored in the remaining pocket 62.

Envelope 2 comprises a first unitary sheet of stock material generally designated as 4. Referring now also to FIG. 2, first sheet 4 has a fold or bend line 6 intermediate its ends which extends transversely across sheet 4 from one side to the other. Fold line 6 divides the first sheet 4 into a back panel 8 having a substantially rectangular configuration and an opposed front panel 10 also having a generally rectangular shape. Fold line 6 is not positioned at the center of first sheet 4, but is situated in such a way that the back panel 8 has a substantially longer length, which length is indicated as 12, than the length 14 of front panel 10. Thus, when sheet 4 is bent along the fold line 6, the front panel 10 has its upper edge 16 terminating intermediate between the fold line 6 and the upper edge 18 of back panel 8.

As shown in FIG. 2, back panel 8 has a width 20 which is slightly greater than the width 22 of front panel 10. Thus, when the sheet 4 is bent along the fold line 6, two cut-out portions 24 (FIG. 4) are formed at the bottom and on each side of envelope 2. In addition, the first sheet 4 is provided with two transverse score lines 26 and 28. Score lines 26 and 28 are located parallel to and closely adjacent fold line 6. Score lines 26 and 28 and cut-outs 24 are provided for a purpose to be described hereafter.

Back panel 8 has two laterally extending flaps or flanges 30 and 32. Flaps 30 and 32 extend over substantially the entire length 12 of back panel 8. Each of the flaps 30 and 32 is integrally connected to the lateral side of back panel 8 along a vertical fold or bend line 34 and 36 respectively. In a manner similar to that for bend line 6, two vertically extending score lines 38 and 40 are located adjacent and parallel to each bend line 34 or 36. Score lines 38 are provided in the back panel 8 while the score lines 40 are provided on the flaps 30 and 32. Each of the flaps 30 and 32 also contains a vertically extending strip of adhesive means 42 on its inner surface. Adhesive means 42 may be of any conventional type for use in assembling envelope 2 from the open unassembled blank of first sheet 4 shown in FIG. 2. Adhesive means 42 preferably comprises an adhesive applied in a liquid form (e.g., a hot melt adhesive, etc.) immediately before the flaps 30 and 32 are secured to front panel 10 and second sheet 44 as described hereafter. Alternatively, adhesive means 42 may need to be activated as by wetting.

Referring now to FIG. 3, envelope 2 also comprises a second or intermediate unitary sheet of stock material which is generally indicated as 44. Sheet 44 has a length 46 which is generally equal to the length 12 of back panel 8. However, length is slightly smaller (e.g., ⅛" less) than length 12. In addition, sheet 44 has a transverse score line 48 positioned parallel to and closely adjacent the lower edge 50 of sheet 44. A horizontal strip of adhesive means 52, identical to adhesive means 42, is located on the back of sheet 44 between score line 48 and the lower edge 50. The first sheet 4 and the second sheet 44 are adapted to be integrally joined together to form a completed envelope 2.

Second sheet 44 has a semi-circular relief or cut-out 54 adjacent its top edge at the center of the sheet. Similarly, first sheet 4 is provided with various reliefs or cut-outs. For example, back panel 8 has a cut-out 56 along its upper edge 18 at the center of the panel as shown in FIG. 2. Front panel 19 has a large rectangular cut-out 58 located adjacent its upper edge. Cut-out 58 is so extensive that the upper edge 16 of the front panel 10 consists of only two upwardly projecting tabs 57 at either side of the front panel. Furthermore, a circular hole 59 is placed in front panel 10 approximately at the center thereof to give a visual indication of material in pocket 62. The various cut-outs 54, 56, and 58 facilitate access into the pockets 60 and 62.

With regard to the assembly of envelope 2, there is a distinction between the bend lines 6, 34, and 36 and the various score lines 26, 28, 38, 40 and 48. A bend line is a portion of the sheet which allows the sheet to be physically bent along this line and, in fact, the sheet is bent along that line in the assembled envelope 2. Score lines are areas of reduced thickness in the sheet which allow the sheet to bend along these lines if the envelope should become distorted. In other words, the score lines are lines along which the sheet will preferably bend to allow the envelope to be expanded. However, the sheet is not necessarily bent along the score lines even for an assembled envelope 2 whenever the envelope is not sufficiently full.

With regard to the preferred method of assembling envelope 2, first sheet 4 has the second sheet 44 integrally secured thereto by adhesive strip 52 which is located on the backside of the sheet 44 between the score line 48 and the bottom edge 50. Adhesive strip 52 will be applied to sheet 44, and sheet 44 will then be superimposed over back panel 8 with strip 52 being placed between fold line 6 and score line 26 thereon. After sheet 44 is integrally secured to back panel 8 along this strip, it extends upwardly and its length 46, which is approximately equal to the length 12 of back panel 8, ensures that back panel 8 and sheet 44 will substantially overlie one another.

After the second sheet 44 is secured in the above-noted manner, lateral flaps 30 and 32 are then bent inwardly along the bend lines 34 and 36 until the flaps overlie both front panel 10 and that portion of the second sheet 44 which extends above the front panel 10. The adhesive strips 42, which were applied to the flaps 30 and 32 substantially immediately before the bending thereof, ensure that the flaps 30 and 32 will be adhesively secured along their entire length to the lateral edges of front panel 10 and the upper portion of second sheet 44. Thus, flaps 30 and 32 both reinforce the sides of envelope 2 and also securely fix or attach the upper portion of sheet 44 to front panel 10. It is preferred that sheet 44 be joined to sheet 4 before securing flaps 30 and 32 as this is the easiest form of assembly. However, sheet 44 could be added after flaps 30 and 32 are attached at their lower half to front panel 10 alone, thus forming an outer envelope housing from first sheet 4.

Referring now to FIG. 5, it can be seen that envelope 2 according to this invention defines two compartments or pockets 60 and 62. The first pocket 60 is located between the back panel 8 and the second sheet 44 with the second pocket 62 being located between the second sheet 44 and the front panel 10. Referring to FIG. 1, because the front panel 10 is substantially shorter than rear panel 8, the entrance opening 64 to the pocket 60 is spaced vertically above the entrance opening 66 to the pocket 62. This difference in height in the entrance openings 64 and 66 means that a person filing various types of documents in envelope 2 is not likely to misfile these documents through confusion of the pockets. For example, X-ray photographs may be easily placed into the pocket 60 with written memoranda being placed into pocket 62. If additional X-ray photographs then have to be filed, the person attempting to place these photographs in pocket 60 would not be at all likely to insert them into the much lower pocket 62 which contains solely written materials.

The provision of the score lines 26, 28, 38, and 40 along the bend lines 5, 34, 36 ensures that envelope 2 can be expanded if the pockets 60 and 62 are substantially filled with various materials. In this regard, the bottom section of envelope 2 will assume a substantially rectangular configuration with the back and front panels 8 and 10 bending, respectively, along the score lines 26 and 28. Similarly, the sides of envelope 2 can be expanded into a substantially rectangular configuration by bending along the score lines 38 and 40. However, the bottom section of the envelope can assume a rectangular configuration as shown in FIG. 6 without the envelope bending along score lines 38 and 40. This might occur when envelope 2 is substantially, but not completely, filled with filed materials.

Another feature of envelope 2 is that intermediate sheet 44 preferably, but not necessarily, extends all the way to the bottom of the envelope. However, this sheet does not prevent the envelope 2 from expanding by virtue of the score line 48 placed therein and the manner in which sheet 44 is secured to back panel 8. When envelope 2 is expanded, the intermediate sheet 44 will bend along the score line 48 as generally shown in FIG. 6. Thus, by virtue of an intermediate sheet 44 which extends the entire length of envelope 2, there is no danger that small documents can communicate in any way between the pockets 60 and 62. However, intermediate sheet 44 does not in any way interfere with the expansion of envelope 2.

With regard to the distances 12 and 14 of the panels, the front panel 10 should be long enough to provide a pocket for most standard sized papers (e.g., $8\frac{1}{2}\times 11''$). Thus, the distance 14 can range anywhere from $8\frac{1}{2}$ to 11 inches to provide the necessary sized pocket. One preferred orientation of envelope 2 utilizes a back panel 8 having a distance 12 of $14\frac{1}{2}$ inches. Therefore, the ratio of the lengths 14:12 can vary any where from 58 to 76% thereof with a preferred value comprising approximately 72%. Such a range ensures that the pocket entrance openings 64 and 66 will be sufficiently vertically offset while ensuring that front pocket 10 is still deep enough to adequately support most papers. Although the above dimensions are preferred, they are not critical. Other dimensions may be utilized if the memoranda to be contained by the pocket 62 have an unusual size or are otherwise oddly shaped.

With regard to FIGS. 7 and 8, a second embodiment of an envelope according to this invention is generally designated as 2*a*. Envelope 2*a* has substantially the same configuration as envelope 2 except for certain exceptions. Elements in envelope 2*a* which correspond to elements in envelope 2 will bear the same reference numerals as those used previously plus an "a" designation.

In any event, envelope 2*a* has a back panel 8*a* and a front panel 10*a* whose widthes 20*a* and 22*a* are substantially the same, thereby deleting cut-outs 24. In addition, none of the components of envelope 2*a*, either the first sheet 4*a* or the second sheet 44, have score lines provided thereon similar to the lines 26, 28, 38, 40, and 48. The absence of such score lines and the absence of cutouts 24 means that the configuration of envelope 2*a* does not allow any substantial expansion of the envelope. In this regard, the intermediate sheet 44*a* is simply integrally secured, as by gluing, adjacent its bottom edge 50*a* to the back panel 10*a* without having any score line 48 therein.

In all other regards, however, both the structure and operation of envelope 2*a* is substantially similar to envelope 2 (i.e., by providing two opposed pockets 60*a* and 62*a* whose inlet openings are substantially vertically offset). The entrance openings to these pockets and the dimensions of the back panel relative to the front panel will generally be the same as for envelope 2.

Thus, this invention relates to an improved dual compartment envelope for efficiently locating X-ray photographs and other materials. The structure of the envelope of this invention minimizes the possibility of the misfiling of materials and ensures that the envelopes can expand as necessary to accomodate the materials placed therein.

The tabs 57 which are located on front panel 10 serve to reinforce the sides of the envelope at the top of the front panel. This assists the front panel 10 in resisting any tearing or rupturing stresses when materials are being inserted into pocket 62. Although tabs 57 provide this function, their shape and length can obviously be varied. In addition, suitable printed indicia, shown generally as 70, may be contained on both the front and back sides of the envelope, i.e., on the outside surface of both the front panel 10 and back panel 8. This indicia will relate respectively to whatever materials the pockets 60 and 62 are designed to accept. For example, if pocket 60 is designed to accept X-ray photographs, indicia on back panel 10 will be a chart for listing and identifying such photographs. However, this indicia may be deleted if so desired.

Referring now to FIG. 4, an alternative method of fixing or securing the intermediate sheet 44 to the first sheet 4 is illustrated. This fixing method includes two semi-circular notches or recesses 72 located in front panel 10 along each side adjacent fold line 6. Only one notch 72 is shown in FIG. 4 with that notch normally being hidden by flap 30. The other notch 72 is positioned on the other side of envelope 2 in a generally similar position beneath flap 32. In any event, when intermediate sheet 34 is located between front panel 10 and back panel 8, a portion of the intermediate sheet 44 will be exposed by notch 72. Intermediate sheet 44 is then fixed to front panel 10 simply by two pieces of tape 74 or the like which extend from front panel 10 into the notches 72. Tape pieces 74 are also normally hidden by the flaps 30 and 32 when the flaps are subsequently used in assembling envelope 2.

First sheet 4 and second sheet 44 are both preferably made of any suitably rigid fibrous material, such as stiff, heavy paper, cardboard, or the like. In this regard, second sheet 44 is somewhat less rigid or stiff than first sheet 4 since it is meant to function only an as interior partition and not as part of the outer envelope housing. Although fibrous materials are preferred for use with first sheet 4 and second sheet 44, these sheets may in fact be made of any other materials which are found to be suitable. Furthermore, the first sheet 4 need not comprise a unitary piece of stock material although this is preferred. Rather, first sheet 4 could comprise two separate pieces of stock maerial to define respectively the back and front panels with these pieces of stock material being joined at one side in a V-shaped arrangement with the point of connection being the apex of the V. Various other modifications to the envelope as shown and described herein will be apparent to those skilled in the art. Thus, the scope of the present invention is to be limited only by the appended claims.

What is claimed is:

1. An improved dual compartment envelope, which comprises the combination of:

(a) a first unitary sheet of stock material having a transverse fold line therein, the fold line defining a front and back panel for the envelope and being situated on the first sheet such that the front panel is substantially shorter than the back panel, the first sheet of stock material being bent along the fold line until the front and back panels are generally contiguous to one another, and wherein the first sheet of stock material has means for allowing expansion of the envelope between the front and back panels;

(b) a second unitary sheet of stock material substantially the same length as the back panel, wherein the second sheet has a score line extending transversely along the second sheet adjacent a bottom edge thereof, the second sheet being attached to the first sheet along the fold line therein only by an adhesive located on that portion of the second sheet between the score line and the bottom edge, whereby the second sheet does not impede expansion of the envelope, a first upwardly opening pocket being defined between the front panel and the second sheet and a second upwardly opening pocket being defined between the second sheet and the back panel; and (c) the back panel having outwardly extending lateral flaps which are connected thereto along vertical fold lines, the lateral flaps being bent to override the front panel and being fixedly secured to lateral edges of both the front panel and an upper portion of the second sheet to form an assembled envelope.

2. An improved envelope as recited in claim 1, in which the first sheet has score lines extending transversely across the first sheet adjacent and to each side of the transverse fold line, and wherein the back panel has a width which is slightly larger than the width of the front panel to define a cut-out portion adjacent each side of the envelope at the transverse fold line, the cut-out portions and the score lines allowing the envelope to be expanded.

3. An improved envelope as recited in claim 2, in which two vertical score lines are provided adjacent each of the vertical fold lines between the back panel and the lateral flaps, the vertical score lines being located respectively on both the lateral flap and the back panel adjacent each fold line, whereby the expandability of the envelope is further increased.

* * * * *

UNITED STATES PATENT AND TRADEMARK OFFICE

CERTIFICATE OF CORRECTION

PATENT NO. : 4,149,667

DATED : April 17, 1979

INVENTOR(S) : Alden R. Riley

It is certified that error appears in the above-identified patent and that said Letters Patent are hereby corrected as shown below:

In column 4, line 9, for "length is slightly smaller" read --length 46 is slightly smaller--.

In column 5, line 30, for "the bend lines 5, 34, 36" read --the bend lines 6, 34, 36--.

Signed and Sealed this

*Eleventh* Day of *September 1979*

[SEAL]

*Attest:*

*Attesting Officer*

LUTRELLE F. PARKER

*Acting Commissioner of Patents and Trademarks*